US007337474B1

(12) United States Patent
Godson

(10) Patent No.: US 7,337,474 B1
(45) Date of Patent: Mar. 4, 2008

(54) GOLF GLOVE WITH GRIP POSITIONING STRAP

(76) Inventor: Kenneth Godson, 33685 Cherry Avenue, Mission, British Columbia (CA) V2V 2V7

( * ) Notice: Subject to any disclaimer, the term of this patent is extended or adjusted under 35 U.S.C. 154(b) by 0 days.

(21) Appl. No.: 11/489,455

(22) Filed: Jul. 20, 2006

(51) Int. Cl.
*A41D 19/00* (2006.01)

(52) U.S. Cl. ..... 2/161.2; 473/205; 473/409

(58) Field of Classification Search ..... 2/161.1–161.5; 473/201, 205, 212, 409
See application file for complete search history.

(56) References Cited

U.S. PATENT DOCUMENTS 2,456,678 A * 12/1948 Cole ..... 2/159
2,852,779 A 9/1958 Roessler
3,105,972 A 10/1963 Christopher
3,274,616 A 9/1966 Russo
3,348,238 A 10/1967 Hydock
3,559,212 A * 2/1971 Skovron ..... 2/161.4
4,057,255 A 11/1977 Bishop
4,329,741 A 5/1982 Bach
5,033,120 A 7/1991 Myers
5,088,122 A 2/1992 O'Toole
5,423,089 A 6/1995 Chun et al.
5,557,805 A 9/1996 Emerson
5,669,073 A 9/1997 Pellington
5,742,942 A 4/1998 Sykes
5,845,374 A 12/1998 Briggs
6,035,442 A 3/2000 Marando
6,073,269 A 6/2000 Diaco
6,223,354 B1 5/2001 Carothers
6,363,535 B1 4/2002 Landis
6,393,615 B1 5/2002 Bedell
6,698,027 B2 3/2004 Park
6,725,465 B2 4/2004 Taylor
6,732,377 B1 5/2004 Wilkinson
2005/0229285 A1 10/2005 Chung

OTHER PUBLICATIONS

Author unknown, ad entitled "Golf is a Sport. Improving Your Grip is a Science", from PGA Tour Partners Magazine, Mar./Apr. 2006, page unknown, volume-issue unknown etc.

* cited by examiner

*Primary Examiner*—Katherine Moran
(74) *Attorney, Agent, or Firm*—Cameron IP

(57) ABSTRACT

According to the present invention there is provided a golf glove for improving a golfer's grip on a golf club. The golf glove includes a palm and a finger part extending from the palm. The finger part has a middle finger, a ring finger, and a little finger. The golf glove includes a golf gripping strap extending from the finger part. The golf gripping strap has a finger-covering portion. The finger-covering portion covers at least some of the finger part. The golf gripping strap has an outer end. The outer end extends from the finger-covering portion. The outer end has a golf gripping strap connector portion. The golf glove includes a thumb heel. The thumb heel has a heel connector portion which is releasably connectable to the golf gripping strap connector. When the golf glove is fitted over a glove hand and the golfer grips the golf club with a normal grip position, the golf gripping strap is connected by the golf gripping strap connector portion to the heel connector portion of the thumb heel. The finger-covering portion thereby extends over the golf club so that the finger part is directed towards the thumb heel.

11 Claims, 1 Drawing Sheet

GOLF GLOVE WITH GRIP POSITIONING STRAP

BACKGROUND OF THE INVENTION

The present invention relates to a golf glove, and in particular, to a golf glove with a grip positioning strap.

A golf glove may have a golf gripping strap that primarily wraps around only the ring finger and the little finger when gripping a golf club in the normal grip position, as disclosed in U.S. Pat. No. 5,845,374 to Briggs and U.S. Pat. No. 5,033,120 to Myers. Alternatively, a golf glove strap may wrap around the middle finger, ring finger and little finger, but require these fingers to be at all times perpendicular to the golf club shaft—in a non-normal grip position, as disclosed in U.S. Pat. No. 5,669,073 to Pellington. As a result, these prior art golf gloves with golf gripping straps are only partially successful at both producing a repeatable normal grip position alignment and securing a firm and uniform force along the middle finger, ring finger and little finger, for firmly gripping the golf club.

The ability of the prior art golf gloves with golf gripping straps to produce a uniformly tight and firm grip is further compromised by the fact that such golf gripping straps are separate parts that must first be cumbersomely connected to the golf glove through hook and loop fasteners, as disclosed in Briggs, Myers, and Pellington. There is therefore a need for a more effective and easier to use golf glove with a grip positioning strap.

SUMMARY OF THE INVENTION

According to the present invention there is provided a golf glove for improving a golfer's grip on a golf club. The golf glove includes a palm and a finger part extending from the palm. The finger part has a middle finger, a ring finger, and a little finger. The golf glove includes a golf gripping strap extending from the finger part. The golf gripping strap has a finger-covering portion. The finger-covering portion covers at least some of the finger part. The golf gripping strap has an outer end. The outer end extends from the finger-covering portion. The outer end has a golf gripping strap connector portion. The golf glove includes a thumb heel. The thumb heel has a heel connector portion which is releasably connectable to the golf gripping strap connector. When the golf glove is fitted over a glove hand and the golfer grips the golf club with a normal grip position, the golf gripping strap is connected by the golf gripping strap connector portion to the heel connector portion of the thumb heel. The finger-covering portion thereby extends over the golf club so that the finger part is directed towards the thumb heel.

According to yet a further aspect of the invention there is provided a method of improving a golfer's golf grip with a golf glove. The golf glove has a golf gripping strap and a thumb heel with a heel connector portion. The method includes the step of placing a glove hand within the golf glove. The method further includes the step of gripping on a golf club shaft of a golf club with a normal grip position. The method further includes the step of stretching the golf gripping strap around the golf club shaft with a non-glove hand. The golf gripping strap has a golf gripping strap connector portion. The method further includes the step of connecting the golf gripping strap by means of the golf gripping strap connector portion to the heel connector portion.

DETAILED DESCRIPTION OF THE PREFERRED EMBODIMENT

Figure 1:
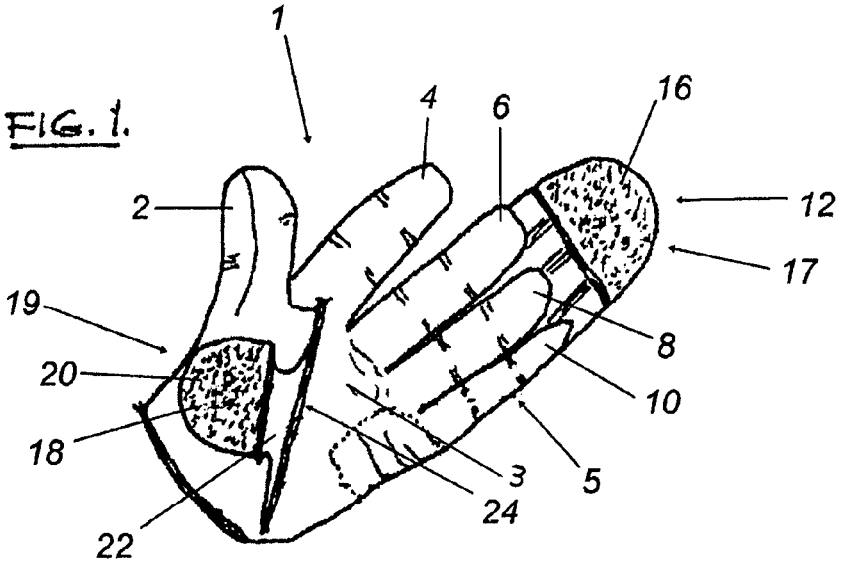
FIG. 1 is a bottom plan view of a golf glove according to an embodiment of the invention showing the palm of the golf glove and the golf gripping strap of the golf glove.

Referring to the drawings and first to FIG. 1, a golf glove according to an embodiment of the invention is shown indicated generally by reference numeral 1. The golf glove 1 includes a palm 3 and a finger part 5 extending from the palm 3. In the embodiment shown in FIGS. 1-3, the finger part 5 has a middle finger 6, a ring finger 8, and a little finger 10. As shown in FIG. 3, the finger part 5 also has a back 15.

There is also a golf gripping strap 12 which extends from the back 15 of the finger part 5. In the embodiment shown in FIGS. 1-3, the golf gripping strap 12 is fixedly connected to the finger part 5. Put another way, the golf gripping strap 12 is fixedly connected to the middle finger 6, ring finger 8 and little finger 10. This connection may be in the form of a sewed connection, an integral extension of the back 15 of the finger part 5, or other suitable means, as are known to those skilled in the art. The golf gripping strap 12 may be of leather, elastic or have some elastic properties. In this example, the golf gripping strap 12 includes a finger-covering portion 14 which covers at least some of the finger part 5. The golf gripping strap 12 also includes an outer end 17 which extends from the finger-covering portion 14. The outer end 17 has a golf gripping strap connector portion 16. The golf gripping strap connector portion 16 is on a plane substantially parallel to the palm 3 when both the golf glove 1 and the golf gripping strap 12 are laid substantially flat and straight.

The golf glove 1 further includes a thumb 2. Adjacent to the thumb 2 is a thumb heel 19 which has a heel connector portion 18. The heel connector portion 18 is releasably connectable to the golf gripping strap connector portion 16. In the embodiment shown in FIGS. 1-3, the golf gripping strap connector portion 16 is a first hook portion of a first hook and loop fastener, and the heel connector portion 18 is a first loop portion of the first hook and loop fastener. However, this connection may equally be in the form of a sewed connection, a loop and tie connection, or other suitable means, as are known to those skilled in the art.

Referring back to the palm 3 of the golf glove 1 and the embodiment shown in FIG. 1, the palm 3 includes a palm raised-portion 22 adjacent to the heel connector portion 18. In this example, the palm raised-portion 22 is in the shape of a thin wedge with inwardly directed elliptical top and end portions, but could equally be in the shape of merely a wedge, a wedge with only an inwardly directed elliptical top portion, a rectangle, or other suitable shape, as are known to those skilled in the art. The palm raised-portion 22 comprises a support material, which may include a padded material, a glove material of extra thickness, laminated layers of leather, a cushioning rubber, or other suitable means, as are known to those skilled in the art.

In this embodiment, the palm 3 further includes a palm strip 24 which is adjacent to the palm raised-portion 22. The palm strip 24 comprises a slotted material, which may include a depression in the glove material in the form of a channel, a section of reduced glove material thickness in the form of a channel, a cut channel in the glove material, one or more channeling rods within the golf glove, or other suitable means, as are known to those skilled in the art. The palm strip 24 is positioned in a direction that begins below the little finger 10 at the base of the palm 3 and extends to the base of the index finger 4 at the top of the palm 3.

In this embodiment and referring to FIG. 3, the golf glove 1 further includes an index finger 4 with lower end 27. The lower end 27 of the index finger 4 is located distal from the outer end 17 of the golf gripping strap 12. The index finger 4 also has a back 25. On the back 25 of the index finger 4 at the lower end 27 of the index finger 4 is an index finger raised-portion 26. In this example, the index finger raised-portion 26 is in the shape of an inverted, rounded L-like shape, but could equally be in the shape of a semi-circle, ellipse, or other suitable shape, as are known to those skilled in the art. The index finger raised-portion 26 comprises a support material, which may include a padded material, a glove material of extra thickness, laminated layers of leather, a cushioning rubber, or other suitable means, as are known to those skilled in the art.

In this embodiment and as shown in FIG. 3, the golf glove 1 further includes a back portion 33 which is on a side opposite to the palm 3. The back portion 33 has a back connector portion 36. In FIG. 3, the back connector portion 36 is hidden by a back strap 34 which extends from the back portion 33. The back strap 34 has a back strap connector portion 38. In the embodiment shown, the back strap connector portion 38 faces the palm 3 when both the golf glove 1 and the back strap 34 are laid substantially flat and straight. The back strap connector portion 38 is releasably connectable to the back connector portion 36. In the embodiment shown in FIGS. 1-3, the back connector portion 36 is a second loop portion of a second hook and loop fastener, and the back strap connector portion 38 is a second hook portion of the second hook and loop fastener. However, this connection may equally be in the form of a sewed connection, a loop and tie connection, or other suitable means, as are known to those skilled in the art.

Figure 2:
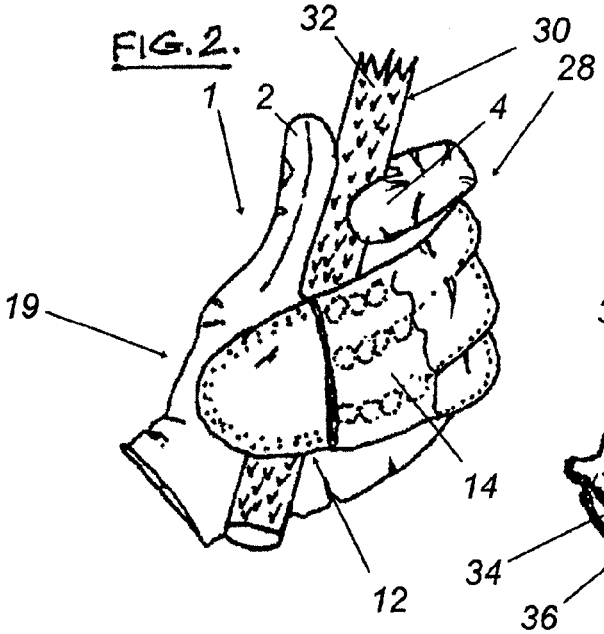
FIG. 2 is a bottom plan view of the golf glove gripping a golf club with a normal grip position and the golf gripping strap stretching around the golf club shaft.
Figure 3:
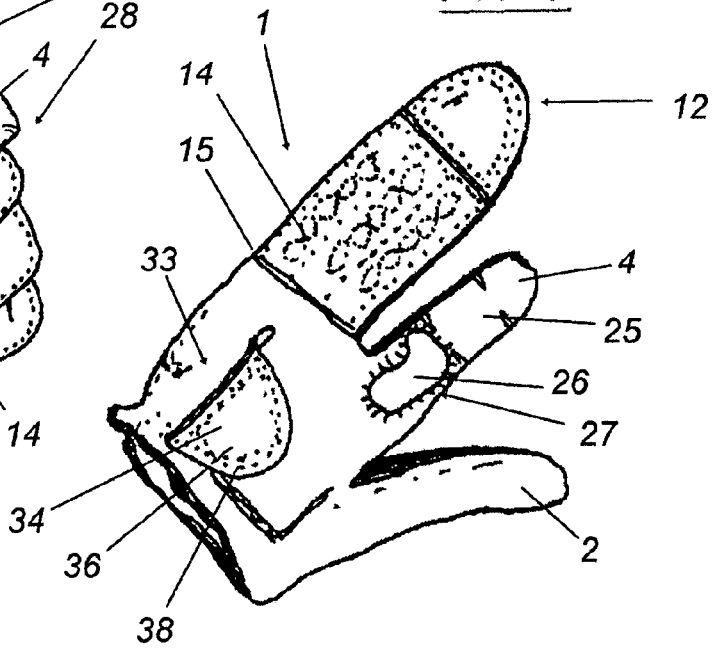
FIG. 3 is a top plan view of the golf glove according to an embodiment of the invention showing the back strap of the golf glove and the index finger raised-portion of the golf glove.

In the embodiment shown in FIGS. 1-3, the golf glove 1 is made of leather. The golf glove 1 may equally be made of a porous material, waterproof material, or other suitable material, as are known to those skilled in the art.

Referring now to the operation of the golf glove 1, the golf glove 1 is fitted over a glove hand (not shown). Referring to FIG. 3, the back strap 34 is connected by means of the back strap connector portion 38 to the back connector portion 36 of the back portion 33. Referring to FIG. 2, a golfer (not shown) then grips a golf club shaft 32 of a golf club 30 with a normal grip position 28. It will be understood by those skilled in the art that this grip position could be at a number of different points along the golf club shaft 32, including, for example, at the golf club shaft end.

In one embodiment, the golf gripping strap 12 is then stretched around the golf club shaft 32 with a non-glove hand (not shown). The golf gripping strap 12 is then connected by the golf gripping strap connector portion 16 to the heel connector portion 18 of the thumb heel 19. The finger-covering portion 14 of the golf gripping strap 12 thereby extends over the golf club shaft 32 so that the finger part 5 is directed towards the thumb heel 19.

The invention thereby provides a both easy-to-connect and efficient method for obtaining a repeatable normal grip position 28 golf grip. A further advantage of the invention arises from the structure of the golf gripping strap 12, which exerts through the golf hand an axial force around the golf club shaft 32 and a longitudinal force in the direction of the shaft end of the golf club 30, resulting in improved club grip, grip comfort, and club control. Because the golf gripping strap 12 is integrally connected to the golf glove 1, the golf glove 1 provides the advantage when in use of a tighter, firmer, more uniform force along all the finger-covering portion 14 fingers—the middle finger 6, the ring finger 8 and the little finger 10, resulting in a superior golf grip and hence club control. This is especially true at the top of the back swing where the last three fingers 6, 8, 10, often slacken and open with more amateur players of the game, thus lessening complete club control. Put another way, the golf glove 1 keeps the fingers 6, 8 and 10 tightly on the heel of the golf club 30 handle or grip, especially at the top of the back swing.

The invention is further enhanced by the golf grip positioning and support features. Elaborating more, after having fitted the golf glove 1 over the golf glove hand and connected the back strap 34, the golf club shaft 32 of the golf club 30 is adjusted to rest on the palm raised-portion 22. This ensures that the golf club shaft 32 runs substantially parallel to the palm raised-portion 22. This further thereby ensures that the glove hand will be at a proper angle with respect to the golf club shaft 32 for a normal grip position 28. Further advantages obtained by the palm raised-portion 22 include: the resulting increased protection that the palm raised-portion 22 provides against wear in this associated high contact and high pressure region of the golf glove 1 when playing golf; and the further benefit of improved, tighter grip on the golf club 30 by filling in the normally depressed area of the palm 3 at its centre when playing golf.

Additionally, the golf club shaft 32 of the golf club 30 is adjusted to also rest on the palm strip 24. This also ensures that the golf club shaft 32 runs substantially parallel to the palm strip 24. This further thereby ensures that the glove hand will be at a proper angle with respect to the golf club shaft 32 for a normal grip position 28.

The invention is additionally enhanced by the index finger raised-portion 26. When in a normal grip position 28, the index finger raised-portion 26 is naturally positioned to allow the non-glove hand to rest on the index finger raised-portion 26. One example of the non-glove hand resting on the index finger raised-portion 26 is allowing a non-glove little finger to rest on the index finger raised-portion 26 when the golfer grips the golf club 30 with the normal grip position 28 and the golf gripping strap 12 is connected by the golf gripping strap connector portion 16 to the heel connector portion 18 of the thumb heel 19. However, it will be understood by those skilled in the art that the non-glove hand could rest on the index finger raised-portion 26 in other manners, according to varying grip styles.

Further advantages of the index finger raised-portion 26 include providing increased protection against the risk of wear of this associated high contact and high pressure region of the golf glove 1 when playing golf. Additionally, it provides the advantage of serving as a reminder for the golfer that the non-glove hand should over lap the index finger 4 of the golf glove 1. The index finger raised-portion 26 provides the further benefit of improved, tighter grip on the golf club 30 by filling in the lower end 27 of the back 25 of the index finger 4 when playing golf. Similarly, the index finger raised-portion 26 allows the little finger of the non-glove hand to anchor more tightly over the index finger 4 of the glove hand when in an overlapping grip.

It will be further understood by those skilled in the art that many of the details provided above are by way of example only and are not intended to limit the scope of the invention which is to be determined with reference to the following claims.

What is claimed is:

1. A golf glove for improving a golfer's grip on a golf club shaft of a golf club, the golf glove comprising:

a palm;

a finger part extending from the palm, the finger part having a middle finger, a ring finger, a little finger, and a back;

a golf gripping strap extending from the finger part, the golf gripping strap being connected to the back of the finger part, the golf gripping strap being fixedly connected to the finger part, the golf gripping strap being elastic, the golf gripping strap having a finger-covering portion, the finger-covering portion covering at least some of the finger part, the golf gripping strap having an outer end, the outer end extending from the finger-covering portion, the outer end having a golf gripping strap connector portion; and a thumb heel, the thumb heel having a heel connector portion which is releasably connectable to the golf gripping strap connector portion;

a palm raised-portion on the palm adjacent to the thumb heel;

a palm strip on the palm adjacent to the palm raised-portion; and an index finger, the index finger having a back and a raised-portion on the back of the index finger, the index finger raised-portion being positioned to allow a non-glove hand to rest on the index finger raised-portion when the golfer grips the golf club with the normal grip position, whereby, when the golf glove is fitted over a glove hand and the golfer grips the golf club with a normal grip position, the golf club shaft rests on the palm raised-portion and the palm strip, the golf gripping strap is connected by the golf gripping strap connector portion to the heel connector portion of the thumb heel and the finger-covering portion thereby extends over the golf club so that the finger part is directed towards the thumb heel.

2. The golf glove as claimed in claim 1, wherein the index finger raised-portion is positioned to allow a non-glove little finger of the non-glove hand to rest on the index finger raised-portion when the golfer grips the golf club with the normal grip position and the golf gripping strap is connected by the golf gripping strap connector portion to the heel connector portion of the thumb heel and the finger-covering portion thereby extends over the golf club so that the finger part is directed towards the thumb heel.

3. The golf glove as claimed in claim 2, wherein the index finger raised-portion is located on a lower end of the index finger, the lower end being located distal from the outer end of the golf gripping strap.

4. The golf glove as claimed in claim 3, wherein the golf glove further includes:

a back portion, the back portion being on a side opposite to the palm and the back portion having a back connector portion; and a back strap extending from the back portion, the back strap having a back strap connector portion which is releasably connectable to the back connector portion;

whereby, when the golf glove is fitted over a glove hand the back strap is connected by means of the back strap connector portion to the back connector portion of the back portion.

5. The golf glove as claimed in claim 4, wherein the golf gripping strap connector portion is a first hook portion of a first hook and loop fastener, the heel connector portion is a first loop portion of the first hook and loop fastener, the back connector portion is a second loop portion of a second hook and loop fastener, and the back strap connector portion is a second hook portion of the second hook and loop fastener.

6. The golf glove as claimed in claim 5, wherein the golf gripping strap connector portion is on a plane substantially parallel to the palm when both the golf glove and the golf gripping strap are laid substantially flat and straight, and the back strap connector portion is faces the palm when both the golf glove and the back strap are laid substantially flat and straight.

7. The golf glove as claimed in claim 6, wherein the golf glove is made of leather.

8. The golf glove as claimed in claim 7, wherein the golf glove is made of a porous material.

9. The golf glove as claimed in claim 8, wherein the golf glove is a waterproof material.

10. A method of improving a golfer's golf grip with a golf glove, the golf glove having a golf gripping strap, a thumb heel with a heel connector portion, a palm, a palm raised-portion on the palm adjacent to the thumb heel, a palm strip adjacent to the palm raised-portion, an index finger, and an index finger raised-portion on the index finger, the index finger raised-portion being on a side opposite to the palm, and the method comprising:

placing a glove hand within the golf glove;

gripping on a golf club shaft of a golf club with a normal grip position;

resting the golf club shaft on the palm raised-portion when the golfer grips the golf club with the normal grip position;

aligning the golf club shaft on the palm strip when the golfer grips the golf club with the normal grip position;

stretching the golf gripping strap around the golf club shaft with a non-glove hand, the golf gripping strap having a golf gripping strap connector portion;

connecting the golf gripping strap by means of the golf gripping strap connector portion to the heel connector portion; and resting a non-gloved little finger of a non-glove hand on the index finger raised-portion when the golfer grips the golf club with the normal grip position.

11. The method as claimed in claim 10, the golf glove further including a back portion, the back portion being on a side opposite to the palm and the back portion having a back connector portion, the golf glove further including a back strap extending from the back portion, the back strap having a back strap connector portion, and the method further including the step of:

connecting the back strap by means of the back strap connector portion to the back connector portion of the back portion, when the golf glove is fitted over a glove hand.

* * * * *